US007835532B2

(12) United States Patent
Yonehara et al.

(10) Patent No.: US 7,835,532 B2
(45) **Date of Patent: *Nov. 16, 2010**

(54) MICROPHONE ARRAY

(75) Inventors: Kentaro Yonehara, Shizuoka (JP); Yoshio Imahori, Shizuoka (JP); Hiroshi Fujinami, Shizuoka (JP); Yasunori Tsukuda, Shizuoka (JP); Motoaki Ito, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 1149 days.

This patent is subject to a terminal disclaimer.

(21) Appl. No.: 11/491,113

(22) Filed: Jul. 24, 2006

(65) Prior Publication Data

US 2007/0019829 A1 Jan. 25, 2007

(30) Foreign Application Priority Data

Jul. 22, 2005 (JP) ..... P2005-213162

(51) Int. Cl.
*H04R 25/00* (2006.01)
*H04R 31/00* (2006.01)

(52) U.S. Cl. ..... 381/150; 29/594

(58) Field of Classification Search ..... 381/174, 381/191, 361; 181/158; 29/25.35, 594, 595, 29/9.1, 886

See application file for complete search history.

(56) References Cited

FOREIGN PATENT DOCUMENTS

| | | | |
|---|---|---|---|
| JP | 02234598 A | * | 9/1990 |
| JP | 2002-345092 A | | 11/2002 |
| JP | 2005-027182 A | | 1/2005 |

* cited by examiner

*Primary Examiner*—Brian Ensey
(74) *Attorney, Agent, or Firm*—Sughrue Mion, PLLC

(57) ABSTRACT

By integrating plural condenser microphone constituting bodies in an array state, a condenser microphone array is obtained.

The condenser microphone array is formed by dicing a laminate of a circuit board forming member, a housing forming member, a spacer forming member, diaphragm sheet, diaphragm plate forming member and a cover forming member which form a part of the plural condenser microphone constituting bodies respectively. In an air chamber of each condenser microphone constituting body constituted in the laminate, a back plate and a contact spring are built.

8 Claims, 8 Drawing Sheets

MICROPHONE ARRAY

BACKGROUND OF THE INVENTION

1. Field of the Invention

This invention relates to a microphone array used for a mobile telephone, a video camera, a personal computer, and the like.

2. Description of the Related Art

Heretofore, as this type of microphone, there is a condenser microphone disclosed in, for example, JP-A-2002-345092. This condenser microphone is manufactured by the following method.

Firstly, a back electrode substrate assembly including plural back electrode substrates, an electrode substrate assembly including plural electrode substrates, a spacer assembly including plural spacers, and a diaphragm support frame assembly which includes plural diaphragm support frames and has laminated diaphragms are laminated. Hereby, a laminate including plural condenser microphone constituting bodies is formed. Next, by cutting this laminate, each condenser microphone constituting body is cut off, and each cut-off condenser microphone constituting body becomes a condenser microphone. According to this method of manufacturing the condenser microphone, it is not necessary to built a diaphragm, a spacer, a back plate, a transistor, and the like in one housing, which is different from a method of manufacturing a condenser microphone disclosed in JP-A-2005-27182. Therefore, productivity of the condenser microphone improves.

SUMMARY OF THE INVENTION

As a microphone for a video camera, a microphone having directivity is generally used. This is because it is desired that whether or not sound recorded by the video camera is sound generated from a picked-up subject is determined clearly. However, the directivity is not provided for the condenser microphones disclosed in JP-A-2002-345092 and JP-A-2005-27182.

Even in such the condenser microphones, by catching the same sound by two or more separate condenser microphones and converting the two sounds into electrical signals, the directivity can be obtained. However, in this case, it is necessary to equip the video camera with the two or more separate condenser microphones, and a small-sized portable recording unit such as the video camera is difficult to mount the condenser microphones thereon because of a problem of their mountability. Further, in a case where a relation between positions where the two or more condenser microphones are installed is not set exactly, a problem that accuracy of detection worsens arises.

An object of this invention is to provide a microphone array which has single configuration, is readily mounted on a small-sized unit, and can obtain directivity of high accuracy.

Further, another object of the invention is to provide a microphone array having good productivity.

In order to achieve the above objects, according to a first aspect of the invention, there is provided a microphone array comprising plural microphone constituting bodies integrated in an array state.

According to a second aspect of the invention, the microphone array according to the first aspect is formed by: using a housing forming member having plural hole portions for forming air chambers respectively, a circuit board forming member for which plural impedance transformation circuits corresponding to the respective air chambers are provided, a spacer forming member for forming plural spacers corresponding to the respective air chambers, a diaphragm sheet for forming plural diaphragms corresponding to the respective spacers, and a diaphragm plate forming member for forming plural diaphragm plates corresponding to the respective diaphragms; laminating the circuit board forming member, the housing forming member, the spacer forming member, the diaphragm sheet, and the diaphragm plate forming member; arranging one back plate for each air chamber formed by the lamination; bonding the respective laminated members integrally and forming a laminate which includes plural condenser microphone constituting bodies; and thereafter cutting the laminate so that the plural condenser microphone constituting bodies are integrated in array.

According to a third aspect of the invention, the microphone array according to the second aspect is configured such that the back plate is built in the air chamber in a state where a contact spring is provided between the back plate and the circuit board.

According to a fourth aspect of the invention, the microphone array according to the second or third aspect is formed by further laminating a cover forming member for forming a cover which covers the diaphragm on the diaphragm plate forming member side of the laminate integrally, and thereafter cutting the laminate.

According to a fifth aspect of the invention, the microphone array is according to any one of the second to fourth aspects is configured such that around the hole portion in the housing forming member, plural holes to be divided by cutting the laminate are provided.

According to the invention, since the plural microphone constituting bodies are integrated in the array state, sound from the same sound source can be caught by the microphone array of the single constitution with a predetermined time lag. Further, by processing the plural sounds having the predetermined time lag, the directivity can be obtained. Therefore, since the microphone array has the single constitution, it becomes ready to be mounted on the small-sized unit. Further, the directivity of high accuracy can be obtained. Furthermore, by increasing the number of the microphone constituting bodies that constitute the microphone array, more sampling data can be obtained on the basis of the sounds from the same sound source. Therefore, the number of samples for calculating the directivity increases, so that stronger directivity can be obtained. Further, as the distance between the microphone constituting bodies becomes larger, the sound from the same sound source can be caught with longer time lag. Therefore, the calculation processing for obtaining the directivity becomes effective, so that stronger directivity can be obtained.

Further, in the laminate formed by laminating the circuit board forming member, the housing forming member, the spacer forming member, the diaphragm sheet and the diaphragm plate forming member, plural portions of which each is a portion except for the back plate in the microphone are formed. Further, by arranging the back plates in the air chambers formed by each forming member, a laminate consisting of the plural microphone constituting bodies is formed. By cutting this laminate, the microphone array in which the plural microphone constituting bodies are integrated so as to form a line is formed. Therefore, compared with the conventional manufacturing method in which the microphones are manufactured one by one, productivity improves.

Further, by providing the plural holes divided by cutting the laminate around the hole portion of the housing forming member, cutting of the laminate becomes easy. Therefore, the productivity of the microphone array improves more. Further, since this hole remains between the microphone constituting bodies without being divided, resonance between the microphone constituting bodies is suppressed. Therefore, by each condenser microphone constituting body, the sound from the same sound source can be surely caught with the time lag, and the directivity can be surely obtained.

DETAILED DESCRIPTION OF THE PREFFERED EMBODIMENTS

Next, one embodiment in which this invention is applied in a back electret type condenser microphone array will be described with reference to FIGS. 1 to 6.

Figure 1:
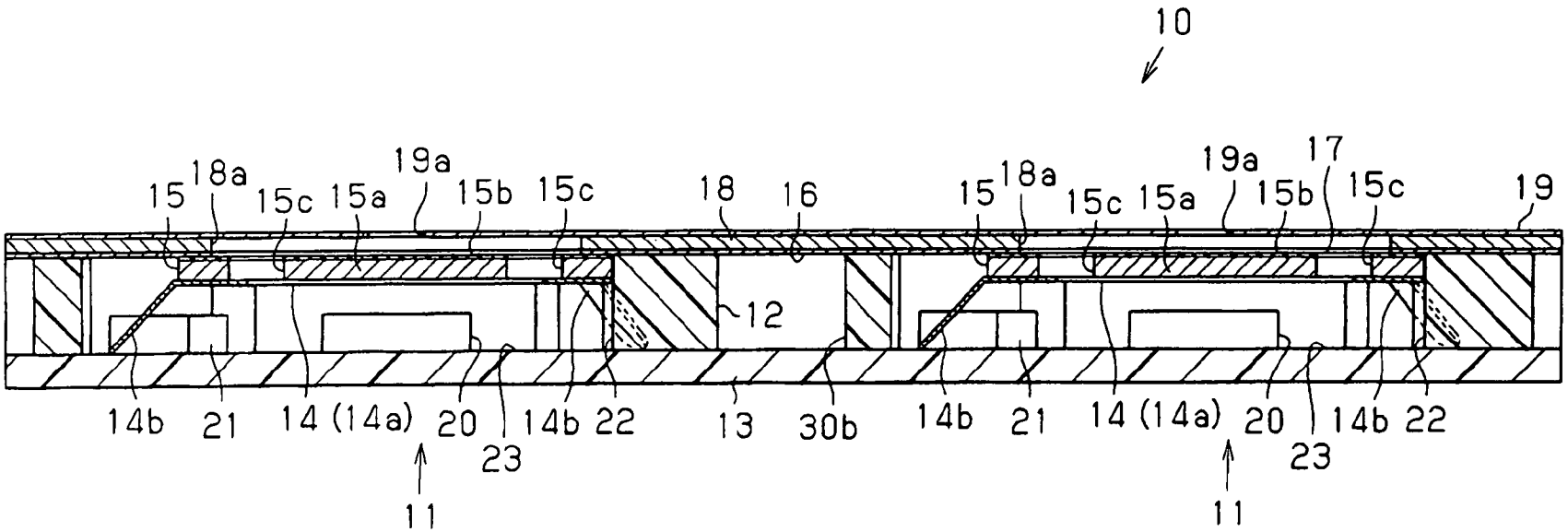
FIG. 1 is a longitudinal sectional view showing a condenser microphone according to one embodiment.
Figure 2:
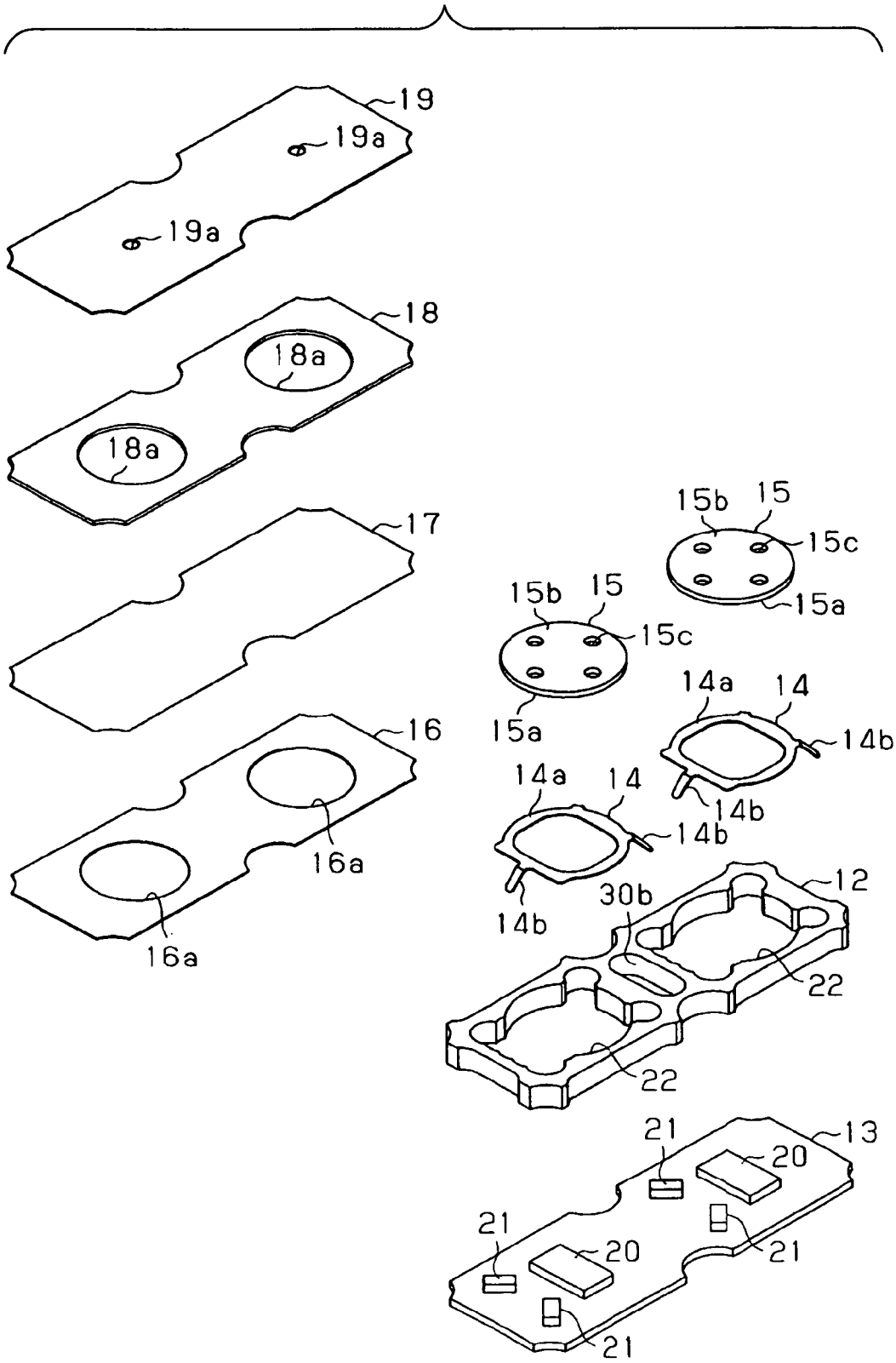
FIG. 2 is an exploded perspective view of the condenser microphone in FIG. 1.
Figure 6:
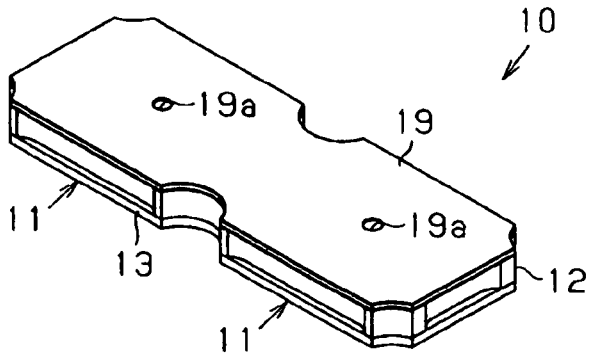
FIG. 6 is a perspective view showing a condenser microphone array.

As shown in FIG. 6, a condenser microphone array (microphone array) 10 according to this embodiment has two same condenser microphone constituting bodies (microphone constituting bodies) 11 which are integrated in an array state. As shown in FIGS. 1 and 2, the condenser microphone array 10 includes a frame-shaped housing 12, a circuit board 13, a contact spring 14, a back plate 15, a spacer 16, a diaphragm 17, a diaphragm plate 18 and a cover 19.

The housing 12 forms a frame of the condenser microphone array 10 and includes two nearly columnar hole portions 22 which form an air chamber 23 respectively. Further, the housing 12 is composed of an electric insulator formed of epoxy resin, liquid crystal polymer, ceramics, or the like. On the circuit board 13, two sets of impedance transformation circuits, each of which includes a field effect transistor 20 and a condenser 21, are formed. Further, for the circuit board 13, the electric configuration such as an electrode pattern, a through hole, and the like (not shown) is provided. The circuit board 13 is bonded and fixed onto the lower surface of the nearly frame-shaped housing 12 in FIG. 1, and the impedance transformation circuit is arranged in each hole portion 22. Further, the contact spring 14 is arranged on the circuit board 13 in each hole portion 22. Each contact spring 14 is formed of a stainless steel plate integrally, and includes a support portion 14*a* which is nearly ring-shaped and three leg portions 14*b* extending downward from this support portion 14*a*. Each leg portion 14*b* is brought into contact with a not-shown land on the circuit board 13, and electrically connected to the impedance transformation circuit through this land. On the upper surface of the support portion 14*a*, the back plate 15 is supported.

The back plate 15 is a disc-shaped plate having the external diameter which is a little smaller than the internal diameter of the hole portion 22 of the housing 12, and the back plate 15 is held in the hole portion 22 movably up and down. The back plate 15 includes a plate body 15*a* formed of a stainless steel plate, and an electret layer 15*b* formed of an FEP (Fluorinated Ethylene Propylene) film on the upper surface of this plate body 15*a*. Polarization processing by corona discharge is applied onto the electret layer 15*b*. Further, the back plate 15 includes plural through-holes 15*c*. The plate body 15*a* of the back plate 15 is electrically connected through the contact spring 14 to the impedance transformation circuit. Onto the upper surface of the housing 12 (in FIG. 1), the spacer 16 is bonded and fixed.

The spacer 16 includes two sets of holes 16*a* each of which has the internal diameter that is smaller than the internal diameter of the hole portion 22 of the housing 12. With the lower surface of the edge portion of each hole 16*a*, the upper surface of the peripheral edge portion of each back plate 15 comes into contact. Each contact spring 14 is held between the circuit board 13 and the back plate 15 in an elastically deformable state. On the other hand, each back plate 15 is brought into pressure contact with the lower surface of the edge portion of each hole 16*a* of the spacer 16 by an elasticity of contact spring 14. Further, the spacer 16 is formed of a film of resin such as PET (PolyEthylene Terephthalate), or a metal plate.

Onto the upper surface of the spacer 16, the diaphragm 17 is bonded and fixed. By the housing 12, the circuit board 13, the spacer 16 and the diaphragm 17, two sets of air chambers 23 (shown in FIG. 1) divided from the outside are formed. Onto the upper surface in FIG. 1 of the diaphragm 17, the diaphragm plate 18 is bonded and fixed. The diaphragm plate 18 has two sets of holes 18*a* each of which has the nearly same internal diameter as the internal diameter of the hole 16*a* of the spacer 16. The diaphragm 17 is held between the spacer 16 and the diaphragm plate 18 except for each hole 18*a*, and the distance between the diaphragm 17 and the back plate 15 is set to a predetermined value by the spacer 16. Namely, by the back plate 15 and the diaphragm 17, a condenser having predetermined impedance is constituted. Further, the diaphragm 17 can vibrate at its portion in each hole 18*a* of the diaphragm plate 18. Onto the upper surface in FIG. 1 of the diaphragm plate 18, the cover 19 is bonded and fixed. The cover 19 covers the diaphragm 17 in each hole 18*a* of the diaphragm 18 from the outside, and includes a sound hole 19*a* for communicating the outside and the diaphragm 17.

In the thus constructed condenser microphone array 10, by sound waves from the sound source, the diaphragm 17 vibrates through the sound hole 19*a* of the cover 19. At this time, with the vibration of the diaphragm 17, air moves freely between the upside and the downside of the back plate 15 through the through-holes 15*c*. Therefore, the vibration of the diaphragm 17 is allowed. Then, the distance between the diaphragm 17 and the back plate 15 changes from the predetermined value, and the impedance of the condenser changes according to a frequency, amplitude, and a waveform of the sound. This change in impedance is transformed into a voltage signal by the impedance transformation circuit and output.

Next, a method of manufacturing the condenser microphone array 10 will be described.

Figure 3:
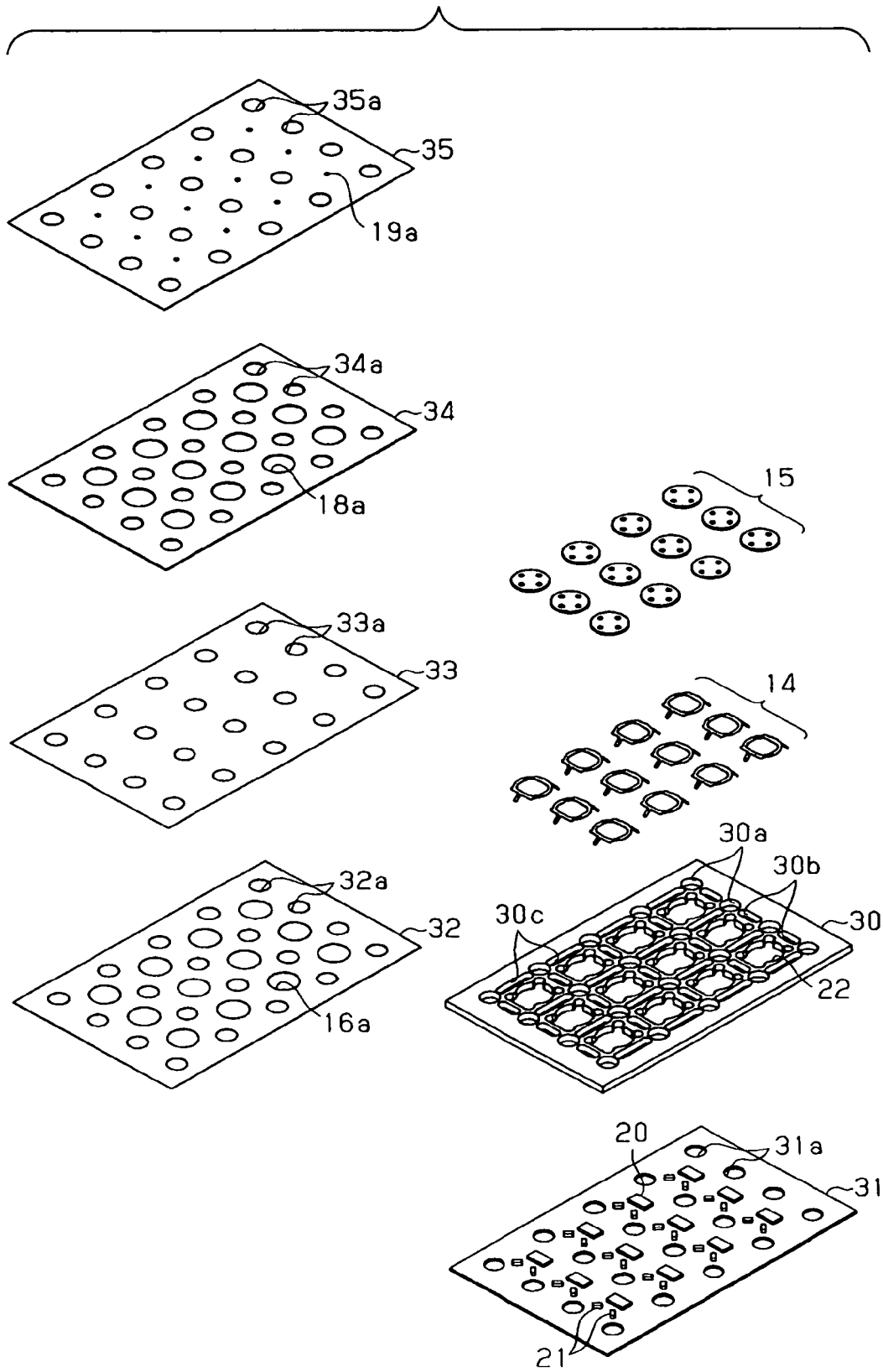
FIG. 3 is a perspective view showing each member used in manufacture of the condenser microphone.

In this manufacturing method, as shown in FIG. 3, using a housing forming member 30, a circuit board forming member 31, a spacer forming member 32, a diaphragm sheet 33, a diaphragm plate forming member 34, a cover forming member 35, the back plates 15 and the contact springs 14, the plural condenser microphone arrays 10 are manufactured.

The housing forming member 30 is a plate material for forming the plural housings 12, and has the plural hole portions 22 formed lengthwise and breadthwise at a predetermined pitch. Further, plural holes 30*a*, long holes 30*b* and long holes 30*c* are provided in the housing forming member 30 at predetermined pitches so as to be located around each hole portion 22. The circuit board forming member 31 is an insulating board for forming the plural circuit boards 13, and has the plural impedance transformation circuits formed lengthwise and breadthwise at the predetermined pitch. Further, in the circuit board forming plate 31, holes 31*a* each having the same diameter as the diameter of the hole 30*a* of the housing forming member 30 are provided in positions corresponding to the holes 30*a*. The spacer forming member 32 is a sheet material for forming the plural spacers 16, and has the plural holes 16*a* formed lengthwise and breadthwise at the predetermined pitch. Further, in the spacer forming plate 32, a hole 32*a* having the same diameter as the diameter of each hole 30*a* of the housing forming member 30 is provided in a position corresponding to each hole 30*a*. The diaphragm sheet 33 is a sheet material for forming the plural diaphragms 17. Further, in the diaphragm sheet 33, a hole 33*a* having the same diameter as the diameter of each hole 32*a* of the spacer forming member 32 is provided in a position corresponding to each hole 32*a*. The diaphragm plate forming member 34 is a sheet material for forming the plural diaphragm plates 18, and has the plural holes 18*a* formed lengthwise and breadthwise at the predetermined pitch. Further, in the diaphragm plate forming member 34, a hole 34*a* having the same diameter as the diameter of each hole 33*a* of the diaphragm sheet 33 is provided in a position corresponding to each hole 33*a*.

Figure 4:
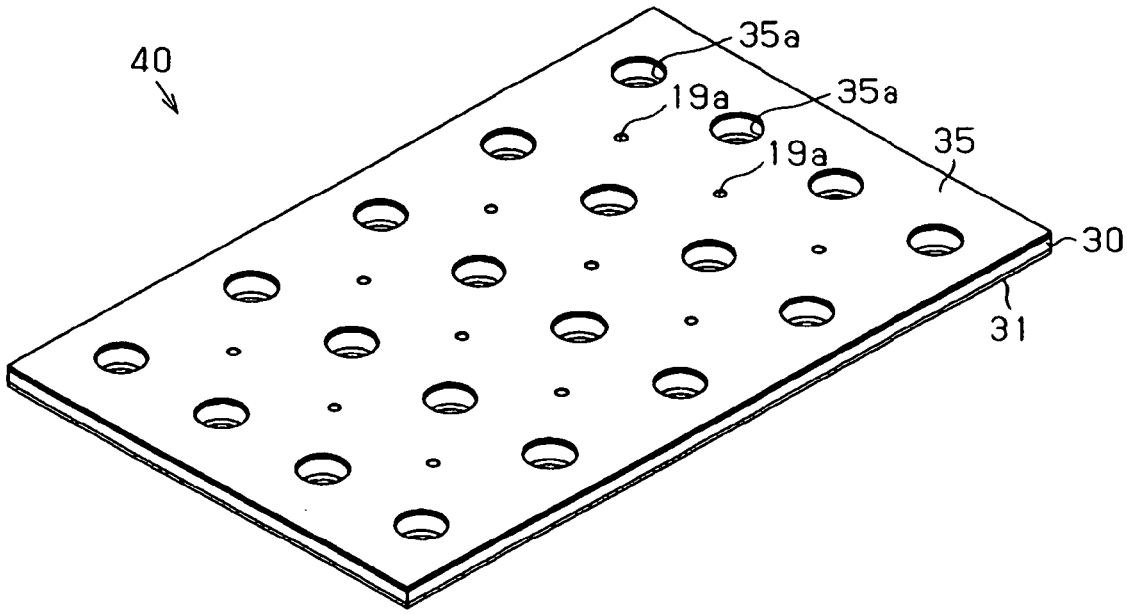
FIG. 4 is a perspective view showing a second microphone assembly.
Figure 5:
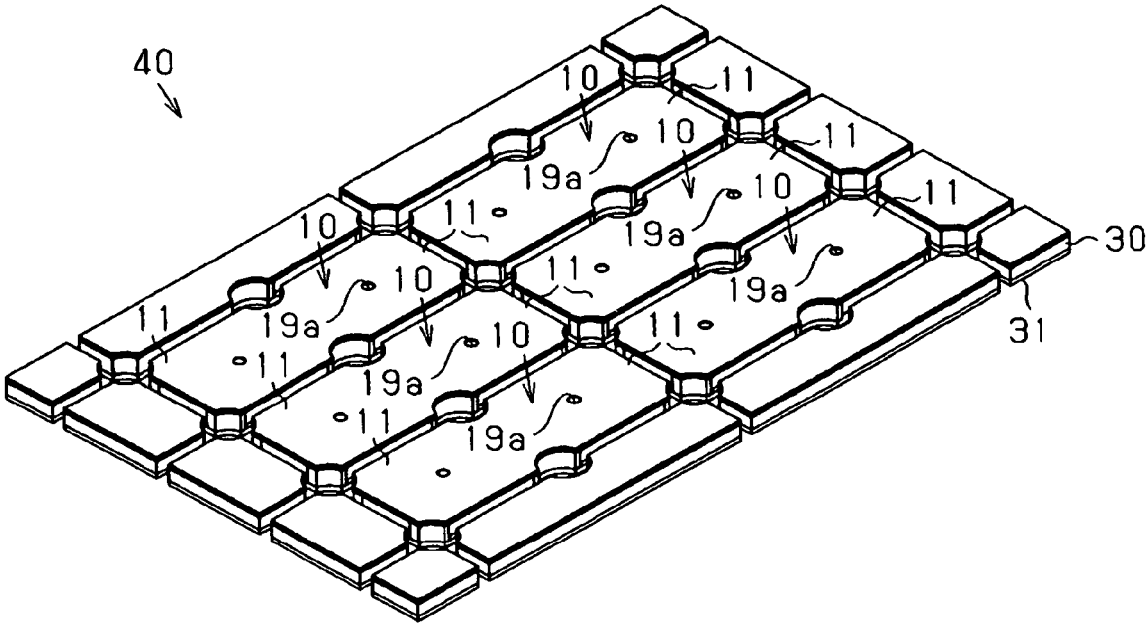
FIG. 5 is a perspective view showing the second microphone assembly after dicing.

In order to manufacture the condenser microphone array 10, the spacer forming member 32 and the diaphragm plate forming member 34 are laminated with the diaphragm sheet 33 therebetween, and the three laminated members are bonded integrally thereby to provide a diaphragm assembly. On the other hand, the circuit board forming member 31 is bonded to the housing forming member 30 integrally thereby to provide a housing assembly. Next, in each hole portion 22 of the housing forming member 30 in this housing assembly, the contact spring 14 and the back plate 15 are built in this order. Next, onto the upper surface of the housing assembly, the diaphragm assembly is bonded integrally thereby to provide a microphone assembly. Next, onto the upper surface of this microphone assembly, the cover forming member 35 is bonded integrally. As shown in FIG. 4, a laminate 40 thus formed includes the plural condenser microphone constituting bodies 11. Lastly, as shown in FIG. 5, the laminate 40 is diced (cut) using a diamond blade into plural condenser microphone arrays 10 each of which has the two condenser microphone constituting bodies 11 integrated in an array state. At this time, in the housing forming member 30 which is formed of epoxy resin, liquid crystal polymer, or ceramic and is the thickest, the holes 30*a*, and the long holes 30*b* and 30*c* which are arranged in an array around the hole portion 22 are divided. Therefore, cutting resistance in dicing is reduced. At this time, between the two condenser microphone constituting bodies 11 arranged in array in the condenser microphone array 10, one long hole 30*b* remains as shown in FIGS. 1 and 2.

FIGS. 3 to 5, for convenience of explanation, show a state where 3×4=12 condenser microphone constituting bodies 11 are formed. However, actually, several hundreds of condenser microphone constituting bodies 11 are formed at a time.

Accordingly, in the condenser microphone array 10 in this embodiment, the two condenser microphone constituting bodies 11 are integrated in the array state. Therefore, sound from the same sound source can be caught by one condenser microphone array 10 with a predetermined time lag. Further, by processing the sounds having the time lag, directivity can be provided for the condenser microphone array 10. Therefore, the directivity can be obtained by one condenser microphone array 10.

Further, this condenser microphone array 10 is manufactured by laminating the housing forming member 30, the circuit board forming member 31, the spacer forming member 32, the diaphragm sheet 33 and the diaphragm plate forming member 34 to form the laminate 40 in which the plural condenser microphone constituting bodies 11 are formed, and thereafter dicing the laminate 40.

Therefore, compared with the condenser microphone disclosed in JP-A-2005-27182 in which the condenser microphones are manufactured one by one, productivity improves.

Further, since the plural holes 30*a* to 30*c* divided by cutting the laminate 40 are arranged in an array around the hole portion 22 in the thickest housing forming member 30, cutting of the laminate 40 becomes easy. Therefore, the productivity of the condenser microphone array 10 improves more.

Further, since the long hole 30*b* remains between the two microphone constituting bodies 11 in the condenser microphone array 10, resonance between the microphone constituting bodies 11 is suppressed. Therefore, by each condenser microphone constituting body 11, the sound from the same sound source can be surely caught with the time lag, and the directivity can be surely obtained. Further, by sealing sound absorbing material such as gelling agent or urethane agent in this long hole 30*b*, resonance interference between the condenser microphone constituting bodies 11 can be suppressed more.

Further, this embodiment can be modified as follows.

(1) In the manufacture of the condenser microphone array 10, a microphone assembly may be diced in a state where a cover forming member 35 is not laminated, and a condenser microphone array 10 having no cover 19 is obtained. Next, a cover 19 is bonded and fixed onto this condenser microphone array 10 and the condenser microphone array 10 is completed.

(2) In the housing forming member 30, in place of each hole portion 22, an upper side recess in which the back plate 15 is arranged, and a lower side recess in which the impedance transformation circuit is arranged may be provided. Further, as the condenser microphone disclosed in JP-A-2005-27182, without the contact spring 14, the back plate 15 held in the upper side recess of the housing forming member 30 may be pressed on the spacer 16. Also in this case, the same advantage as that in the above embodiment is obtained.

Figure 7:
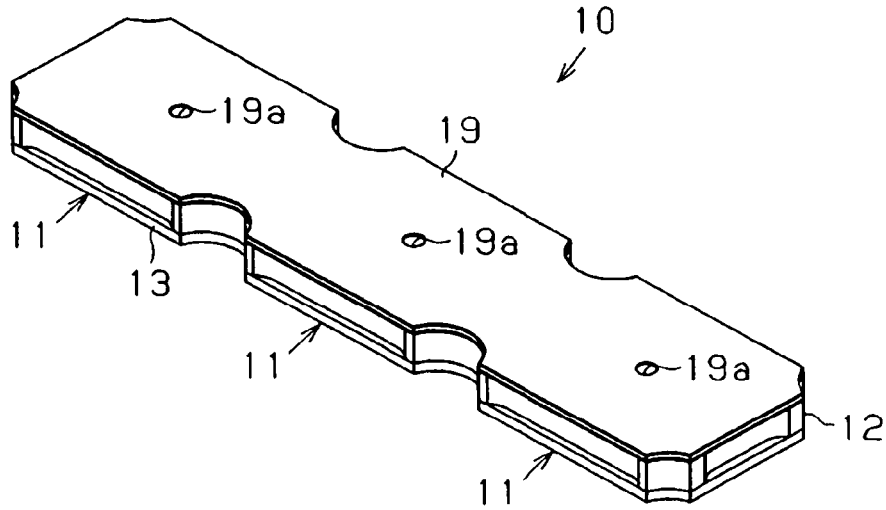
FIG. 7 is a perspective view showing a condenser microphone array according to another embodiment.
Figure 8:
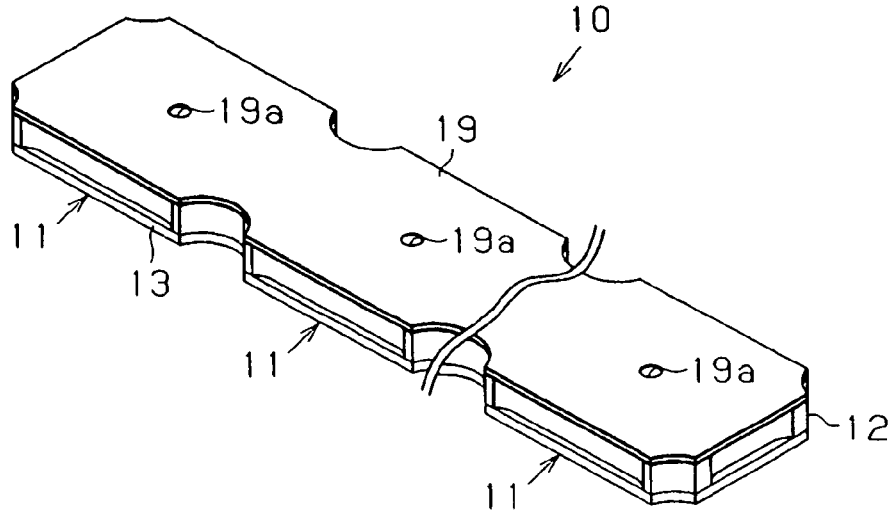
FIG. 8 is a perspective view showing a condenser microphone array according to another embodiment.
Figure 9:
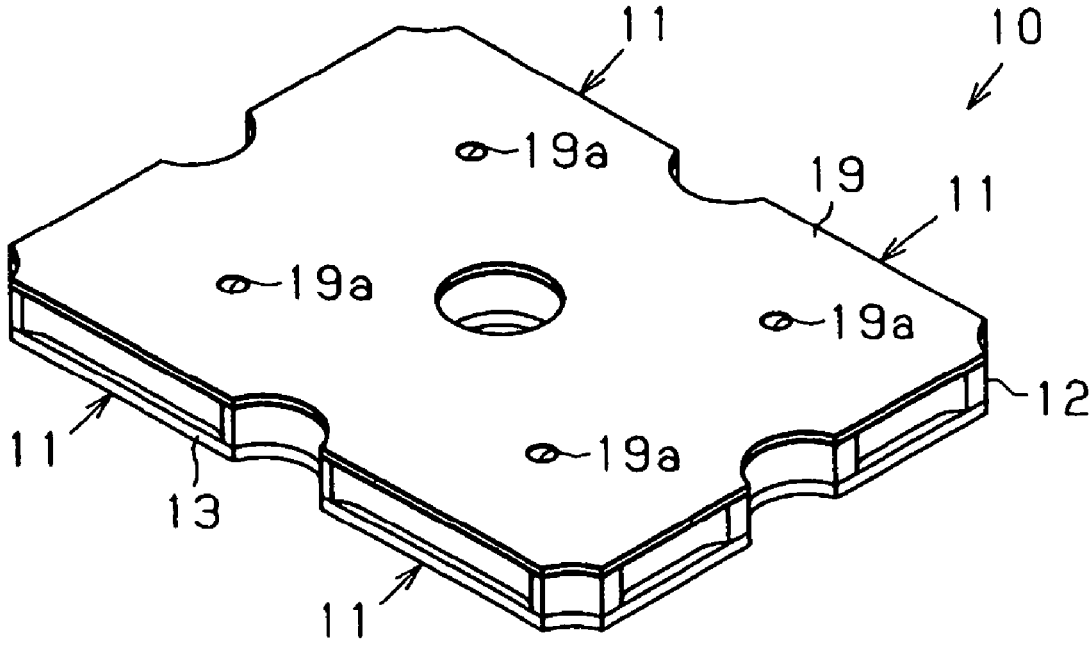
FIG. 9 is a perspective view showing a condenser microphone array according to another embodiment.
Figure 10:
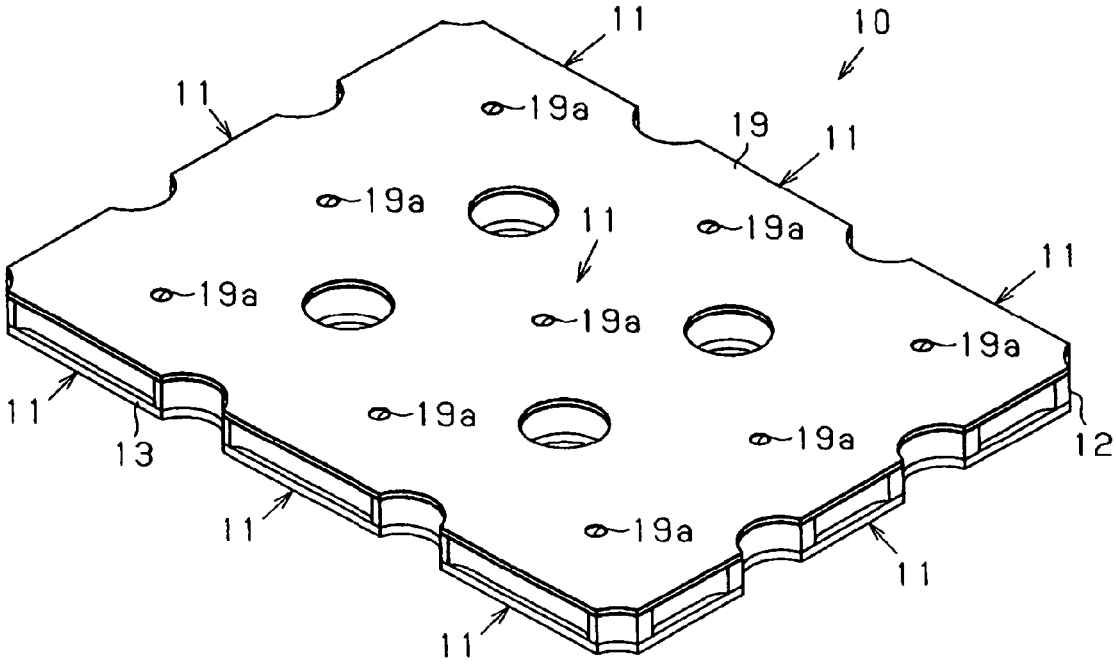
FIG. 10 is a perspective view showing a condenser microphone array according to another embodiment.

(3) As shown in FIG. 7, a condenser microphone array 10 may be formed by integrating three condenser microphone constituting bodies 11 in a state where they are arranged in a line. Alternatively, as shown in FIG. 8, a condenser microphone array 10 may be formed by integrating four or more condenser microphone constituting bodies 11 in a state where they are arranged in a line. Alternatively, as shown in FIG. 9, a condenser microphone array 10 may be formed by integrating four condenser microphone constituting bodies 11 in a state where they are arranged in two rows in each of the longitudinal and transverse directions. Alternatively, as shown in FIG. 10, a condenser microphone array 10 may be formed by integrating nine condenser microphone constituting bodies 11 in a state where they are arranged in three rows in each of the longitudinal and transverse directions. As described above, three or more condenser microphone constituting bodies 11 can be integrated in the array state. In this case, as the number of the microphone constituting bodies which constitute the microphone array increases, more sampling data can be obtained on the basis of the sounds from the same sound source. Therefore, the number of the samples for calculating the directivity increases, and stronger directivity can be obtained. Further, as the distance between the microphone constituting bodies is made longer, the sound from the same sound source can be caught with the longer time lag. Therefore, the calculation processing for obtaining the directivity becomes effective, and the stronger directivity can be obtained.

(4) This invention is applicable to a foil-type electret condenser microphone array in which an electret function is provided for the diaphragm 17 in place of the back plate 15.

(5) This invention is applicable to a charge pump type condenser microphone array in which the back plate 15 and the diaphragm 17 receive a voltage from a charge pump circuit, without having the electret function.

(6) This invention is applicable to a microphone array manufactured by MEMS (Micro Electro Mechanical System) technology.

In this microphone array, microphones each of which includes a diaphragm composed of a silicon board worked by the MEMS technology are integrated in the array state.

What is claimed is:

1. A microphone array comprising a plurality of microphone constituting bodies integrated in an array state being formed by: using a housing forming member having plural hole portions for forming air chambers respectively, a circuit board forming member for which plural impedance transformation circuits corresponding to the respective air chambers are provided, a spacer forming member for forming plural spacers corresponding to the respective air chambers, a diaphragm sheet for forming plural diaphragms corresponding to the respective spacers, and a diaphragm plate forming member for forming plural diaphragm plates corresponding to the respective diaphragms; laminating the circuit board forming member, the housing forming member, the spacer forming member, the diaphragm sheet, and the diaphragm plate forming member; arranging one back plate for each air chamber formed by the lamination; bonding the respective laminated members integrally and forming a laminate which includes plural condenser microphone constituting bodies; and thereafter cutting the laminate so that the plural condenser microphone constituting bodies are integrated in array.

2. The microphone array according to claim 1, wherein the back plate is built in the air chamber in a state where a contact spring is provided between the back plate and the circuit board.

3. The microphone array according to claim 1 being formed by further laminating a cover forming member for forming a cover which covers the diaphragm on the diaphragm plate forming member side of the laminate integrally, and thereafter cutting the laminate.

4. The microphone array according to claim 2 being formed by further laminating a cover forming member for forming a cover which covers the diaphragm on the diaphragm plate forming member side of the laminate integrally, and thereafter cutting the laminate.

5. The microphone array according to claim 1, wherein around the hole portion in the housing forming member, plural holes to be divided by cutting the laminate are provided.

6. The microphone array according to claim 2, wherein around the hole portion in the housing forming member, plural holes to be divided by cutting the laminate are provided.

7. The microphone array according to claim 3, wherein around the hole portion in the housing forming member, plural holes to be divided by cutting the laminate are provided.

8. The microphone array according to claim 4, wherein around the hole portion in the housing forming member, plural holes to be divided by cutting the laminate are provided.

* * * * *